US010127919B2

(12) United States Patent
Erkelens

(10) Patent No.: US 10,127,919 B2
(45) Date of Patent: Nov. 13, 2018

(54) DETERMINING NOISE AND SOUND POWER LEVEL DIFFERENCES BETWEEN PRIMARY AND REFERENCE CHANNELS

(71) Applicant: Cirrus Logic Inc., Austin, TX (US)

(72) Inventor: Jan S. Erkelens, Delft (NL)

(73) Assignee: Cirrus Logic, Inc., Austin, TX (US)

( * ) Notice: Subject to any disclaimer, the term of this patent is extended or adjusted under 35 U.S.C. 154(b) by 27 days.

(21) Appl. No.: 14/938,798

(22) Filed: Nov. 11, 2015

(65) Prior Publication Data

US 2016/0134984 A1 May 12, 2016

Related U.S. Application Data

(60) Provisional application No. 62/078,828, filed on Nov. 12, 2014.

(51) Int. Cl.
*H04R 29/00* (2006.01)
*G10L 21/0232* (2013.01)
(Continued)

(52) U.S. Cl.
CPC ..... *G10L 21/0232* (2013.01); *G10L 25/12* (2013.01); *G10L 25/21* (2013.01); *H04R 3/005* (2013.01); *H04R 2410/05* (2013.01)

(58) Field of Classification Search
CPC ..... H04R 3/005; H04R 2410/05; G10L 25/12; G10L 25/21; G10L 21/0232
(Continued)

(56) References Cited

U.S. PATENT DOCUMENTS 9,378,754 B1 * 6/2016 Every ..... G10L 21/0208
2012/0123772 A1 * 5/2012 Thyssen ..... G10L 21/0208 704/226

(Continued)

FOREIGN PATENT DOCUMENTS

EP 2770750 A1 8/2014

OTHER PUBLICATIONS

United States Internaitonal Searching Authority; International Search Report & Written Opinion issued for PCT/US2015/060323 dated Jan. 13, 2016; Alexandria, VA; US.

*Primary Examiner* — William A Jerez Lora
(74) *Attorney, Agent, or Firm* — Kirk Dorius; Dorius Law P.C.

(57) ABSTRACT

A method for estimating a noise power level difference (NPLD) between a primary microphone and a reference microphone of an audio device includes obtaining primary and reference channels of an audio signal with primary and reference microphones of an audio device and estimating a noise magnitude of the reference channel of the audio signal to provide a noise variance estimate for one or more frequencies. A modelled probability density function (PDF) of a fast Fourier transform (FFT) coefficient of the primary channel of the audio signal is maximized to provide a NPLD between the noise variance estimate of the reference channel and a noise variance estimate of the primary channel. A modelled PDF of an FFT coefficient of the reference channel of the audio signal is maximized to provide a complex speech power level difference (SPLD) coefficient between the speech FFT coefficients of the primary and reference channel. A corrected noise magnitude of the reference channel is then calculated based on the noise variance estimate, the NPLD and the SPLD coefficient.

22 Claims, 5 Drawing Sheets

(51) Int. Cl.

| | |
|---|---|
| *G10L 25/12* | (2013.01) |
| *G10L 25/21* | (2013.01) |
| *H04R 3/00* | (2006.01) |

(58) Field of Classification Search
USPC ..... 381/56
See application file for complete search history.

(56) References Cited

U.S. PATENT DOCUMENTS

| | | | | |
|---|---|---|---|---|
| 2013/0117014 | A1* | 5/2013 | Zhang | G10L 21/00 704/207 |
| 2014/0029762 | A1* | 1/2014 | Xie | H04R 5/027 381/94.1 |
| 2014/0037100 | A1* | 2/2014 | Giesbrecht | G10K 11/002 381/71.8 |
| 2014/0086425 | A1 | 3/2014 | Jensen et al. | |
| 2014/0270223 | A1 | 9/2014 | Li et al. | |
| 2014/0286497 | A1 | 9/2014 | Thyssen et al. | |

* cited by examiner

DETERMINING NOISE AND SOUND POWER LEVEL DIFFERENCES BETWEEN PRIMARY AND REFERENCE CHANNELS

CROSS REFERENCE TO RELATED APPLICATION

This patent application claims the benefit of and priority to Provisional Application Ser. No. 62/078,828 filed Nov. 12, 2014, and titled "Determining Noise Power Level Difference and/or Sound Power Level Difference between Primary and Reference Channels of an Audio Signal." which is incorporated herein in its entirety by reference.

FIELD OF THE INVENTION

This disclosure relates to techniques for determining a difference in the power levels of noise and/or sound between a primary channel of an audio signal and a reference channel of the audio signal.

BACKGROUND OF THE INVENTION

Many techniques for filtering or otherwise clarifying audio signals rely upon signal to noise ratios (SNRs). An SNR typically employs an estimate of the amount of noise, or power level of noise, in the audio signal.

A variety of audio devices, including state of the art mobile telephones, include a primary microphone that is positioned and oriented to receive audio from an intended source, and a reference microphone that is positioned and oriented to receive background noise while receiving little or no audio from the intended source. The principal function of the reference microphone is to provide an indicator of the amount of noise that is likely to be present in a primary channel of an audio signal obtained by the primary microphone. Conventionally, it has been assumed that the level of noise in a reference channel of the audio signal, which is obtained with the reference microphone, is substantially the same as the level of noise in the primary channel of the audio signal.

In reality, there may be significant differences between the noise level present in the primary channel and the noise level present in the corresponding reference channel. These differences may be caused by any of a number of different factors, including, without limitation, an imbalance in the manner in which (e.g., the sensitivity with which) the primary microphone and the reference microphone detect sound, the orientations of the primary microphone and the reference microphone relative to an intended source of audio, shielding of noise and/or sound (e.g., by the head and/or other parts of an individual as he or she uses a mobile telephone, etc.) and prior processing of the primary and/or reference channels. When the noise level in the reference channel is greater than the noise level in the primary channel, efforts to remove or otherwise suppress noise in the primary channel may result in over suppression, or the undesired removal of portions of targeted sound (e.g., speech, music, etc.) from the primary channel, as well as in distortion of the targeted sound. Conversely, when the noise level in the reference channel is less than the noise level in the primary channel, noise from the primary channel may be under suppressed, which may result in undesirably high levels of residual noise in the audio signal output by noise suppression processing.

The presence of targeted sound (e.g., speech, etc.) into the reference channel may also introduce error into the estimated noise level and, thus, adversely affect the quality of an audio signal from which noise has been removed or otherwise suppressed.

Accordingly, improvements are sought in estimating the differences in noise and speech power levels.

SUMMARY OF THE INVENTION

The average noise and speech power levels in the primary and reference microphones are generally different. The inventor has conceived and described methods to estimate a frequency dependent Noise Power Level Difference (NPLD) and a Speech Power Level Difference (SPLD). While the way that the present invention addresses the disadvantages of the prior art will be discussed in greater detail below, in general, the present invention provides a method for using the estimated NPLD and SPLD to correct the noise variance estimate from the reference microphone, and to modify the Level Difference Filter to take into account the PLDs. While aspects of the invention may be described with regard to cellular communications, aspects of the invention may be applied to any number of audio, video or other data transmissions and related processes.

In various aspects, this disclosure relates to techniques for accurately estimating the noise power and/or sound power in a first channel (e.g., a reference channel, a secondary channel, etc.) of an audio signal and minimizing or eliminating any difference between that noise power and/or sound power and the respective noise power and/or sound power in a second channel (e.g., a primary channel, a reference channel, etc.) of the audio signal.

In one aspect, a technique is disclosed for tracking the noise power level difference (NPLD) between a reference channel of an audio signal and a primary channel of the audio signal. In such a method, an audio signal is simultaneously obtained from a primary microphone and at least one reference microphone of an audio device, such as a mobile telephone. More specifically, the primary microphone receives the primary channel of the audio signal, while the reference microphone receives the reference channel of the audio signal.

A so called "maximum likelihood" estimation technique may be used to determine the NPLD between the primary channel and the reference channel. The maximum likelihood estimate technique may include estimating a noise magnitude, or a noise power, of the reference channel of the audio signal, which provides a noise magnitude estimate. In a specific embodiment, estimation of the noise magnitude may include use of a data driven recursive noise power estimation technique, such as that disclosed by Erkelens, J. S., et al., "Tracking of Nonstationary Noise Based on Data Drive Recursive Noise Power Estimation," IEEE Transactions on Audio, Speech, and Language Processing, 16(6): 1112 1123 (2008) ("Erkelens"), the entire disclosure of which is hereby incorporated by reference for all purposes.

With the noise magnitude estimate, a probability density function (PDF) of a fast Fourier transform (FFT) coefficient of the primary channel of the audio signal may be modeled. In some embodiments, modeling of the PDF of an FFT coefficient of the primary channel may comprise modeling it as a complex Gaussian distribution, with a mean of the complex Gaussian distribution being dependent upon the NPLD. Maximizing the joint PDF of the FFT coefficients for a particular portion of the primary channel of the audio signal with respect to the NPLD provides an NPLD value that can be calculated from the reference channel and the primary channel of the audio signal. With an accurate NPLD, the noise magnitude, or noise power, of the primary audio signal may be accurately related to the noise magnitude, or noise power of the reference audio signal.

In various embodiments, these processes may be continuous and, therefore, include tracking of the noise variance estimate as well as of the NPLD. The rate at which the tracking process occurs may depend, at least in part, upon the likelihood that targeted sound (e.g., speech, music, etc.) is present in the primary channel of the audio signal. In embodiments where targeted sound is likely to be present in the primary channel, the rate of the tracking process may be slowed by using the smoothing factors taught by Erkelens, which may enable more sensitive and/or accurate tracking of the NPLD and the noise magnitude, or noise power, and, thus, less distortion of the targeted sound as noise is removed therefrom or otherwise suppressed. In embodiments where targeted sound is probably not present in the primary channel, the tracking process may be conducted at a faster rate.

In another aspect, a speech power level difference (SPLD) between the primary channel and the reference channel may be determined. The SPLD may be determined by expressing the FFT coefficients of the primary channel as a function of those of the reference channel. In some embodiments, modeling of the PDF of the FFT coefficients of the primary channel may comprise modeling it as a complex Gaussian distribution, with a mean and variance of the complex Gaussian distribution being dependent upon the SPLD. Maximizing the joint PDF of the FFT coefficients for a particular portion of the primary channel of the audio signal with respect to the SPLD provides an SPLD value that can be calculated from the reference channel and the primary channel of the audio signal.

The SPLD may be continuously calculated, or tracked. In some embodiments, the rate of tracking the SPLD between a primary channel and a reference channel of an audio signal may depend upon the likelihood that speech is present in the primary channel of the audio signal. In embodiments where speech is likely to be present in the primary channel, the rate of tracking may be increased. In embodiments where speech is not likely to be present in the primary channel, the rate of tracking may be reduced, which may enable more sensitive and/or accurate tracking of the SPLD.

According to another aspect of this disclosure, NPLD and/or SPLD tracking may be used in audio filtering and/or clarification processes. Without limitation, NPLD and/or SPLD tracking may be used to correct noise magnitude estimates of a reference channel upon generation of the reference channel (e.g., by a reference microphone, etc.), following an initial filtering (e.g., adaptive least mean squared (LMS), etc.) process, before minimum mean squared error (MMSE) filtering of the primary and reference channels of an audio signal, or in level difference post processing (i.e., after a principal clarification process, such as MMSE, etc.).

One aspect of the invention features, in some embodiments, a method for estimating a noise power level difference (NPLD) between a primary microphone and a reference microphone of an audio device. The method includes obtaining a primary channel of an audio signal with a primary microphone of an audio device; obtaining a reference channel of the audio signal with a reference microphone of the audio device; and estimating a noise magnitude of the reference channel of the audio signal to provide a noise variance estimate for one or more frequencies. The method further includes modeling a probability density function (PDF) of a fast Fourier transform (FFT) coefficient of the primary channel of the audio signal; maximizing the PDF to provide a NPLD between the noise variance estimate of the reference channel and a noise variance estimate of the primary channel; modeling a PDF of an FFT coefficient of the reference channel of the audio signal; maximizing the PDF to provide a complex speech power level difference (SPLD) coefficient between the speech FFT coefficients of the primary and reference channel; and calculating a corrected noise magnitude of the reference channel based on the noise variance estimate, the NPLD and the SPLD coefficient.

In some embodiments, a noise power level of the reference channel differs from a noise power level of the primary channel. In some embodiments, estimating the noise magnitude of the reference channel, modeling the PDF of the FFT coefficient of the primary channel and maximizing the PDF are effected continuously and include tracking the NPLD. In some embodiments, tracking the NPLD includes exponential smoothing of statistics across consecutive time frames. In some embodiments, exponential smoothing of statistics across consecutive time frames includes data-driven recursive noise power estimation.

In some embodiments, the method includes determining a likelihood that speech is present in at least the primary channel of the audio signal. In some embodiments, if speech is likely to be present in at least the primary channel of the audio signal, the method includes slowing a rate at which the tracking occurs.

In some embodiments, estimating the noise magnitude of the reference channel includes data-driven recursive noise power estimation.

In some embodiments, modeling the PDF of the FFT coefficient of the primary channel of the audio signal includes modeling a complex Gaussian PDF, with a mean of the complex Gaussian distribution being dependent upon the NPLD.

In some embodiments, the method includes determining relative strengths of speech in the primary channel of the audio signal and speech in the reference channel of the audio signal. In some embodiments, determining relative strengths includes tracking the relative strengths over time. In some embodiments, the method includes determining relative strengths includes data-driven recursive noise power estimation. In some embodiments, the method includes applying a least mean square (LMS) filter prior to applying the NPLD and the SPLD coefficients.

In some embodiments, estimating the noise magnitude of the reference channel, modeling the PDF of the FFT coefficient of the primary channel and maximizing the PDF occur before at least some filtering of the audio signal. In some embodiments, estimating the noise magnitude of the reference channel, modeling the PDF of the FFT coefficient of the primary channel and maximizing the PDF occur before minimum mean squared error (MMSE) filtering of the primary channel and the reference channel.

In some embodiments, modeling the PDF of the FFT coefficient of the reference channel includes modeling a complex Gaussian distribution, with a mean of the complex Gaussian distribution being dependent on the complex SPLD coefficient.

In some embodiments, estimating the noise magnitude of the reference channel, modeling the PDFs of the FFT coefficients of the primary channel and reference channel and maximizing the PDFs includes scaling a noise variance of the reference channel for level difference post-processing of an audio signal after the audio signal has been subjected to a principal filtering or clarification process.

In some embodiments, the method includes using the NPLD and SPLD in detecting one or more of voice activity and identifiable speaker voice activity.

In some embodiments, the method includes using the NPLD and SPLD in selection between microphones to achieve the highest signal to noise ratio.

Another aspect of the invention features, in some embodiments, an audio device, comprising: a primary microphone for receiving an audio signal and for communicating a primary channel of the audio signal; a reference microphone for receiving the audio signal from a different perspective than the primary microphone and for communicating a reference channel of the audio signal; and at least one processing element for processing the audio signal to filter and or clarify the audio signal, the at least one processing element being configured to execute a program for effecting a method for estimating a noise power level difference (NPLD) between a primary microphone and a reference microphone of an audio device. The method includes obtaining a primary channel of an audio signal with a primary microphone of an audio device; obtaining a reference channel of the audio signal with a reference microphone of the audio device; and estimating a noise magnitude of the reference channel of the audio signal to provide a noise variance estimate for one or more frequencies. The method further includes modeling a probability density function (PDF) of a fast Fourier transform (FFT) coefficient of the primary channel of the audio signal; maximizing the PDF to provide a NPLD between the noise variance estimate of the reference channel and a noise variance estimate of the primary channel; modeling a PDF of an FFT coefficient of the reference channel of the audio signal; maximizing the PDF to provide a complex speech power level difference (SPLD) coefficient between the speech FFT coefficients of the primary and reference channel; and calculating a corrected noise magnitude of the reference channel based on the noise variance estimate, the NPLD and the SPLD coefficient.

Various embodiments of an audio device according to this disclosure include at least one processing element that may be programmed to execute any of the disclosed processes. Such an audio device may comprise any electronic device that with two or more microphones for receiving audio or any device that is configured to receive two or more channels of an audio signal. Some embodiments of such a device include, but are not limited to, mobile telephones, telephones, audio recording equipment and some portable media players. The processing element(s) of such a device may include microprocessors, microcontrollers and the like.

Other aspects, as well as features and advantages of various aspects, of the disclosed subject matter should be apparent to those of ordinary skill in the art through consideration of the disclosure provided above, the accompanying drawing and the appended claims. Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

DETAILED DESCRIPTION OF THE PREFERRED EMBODIMENTS

Figure 1:
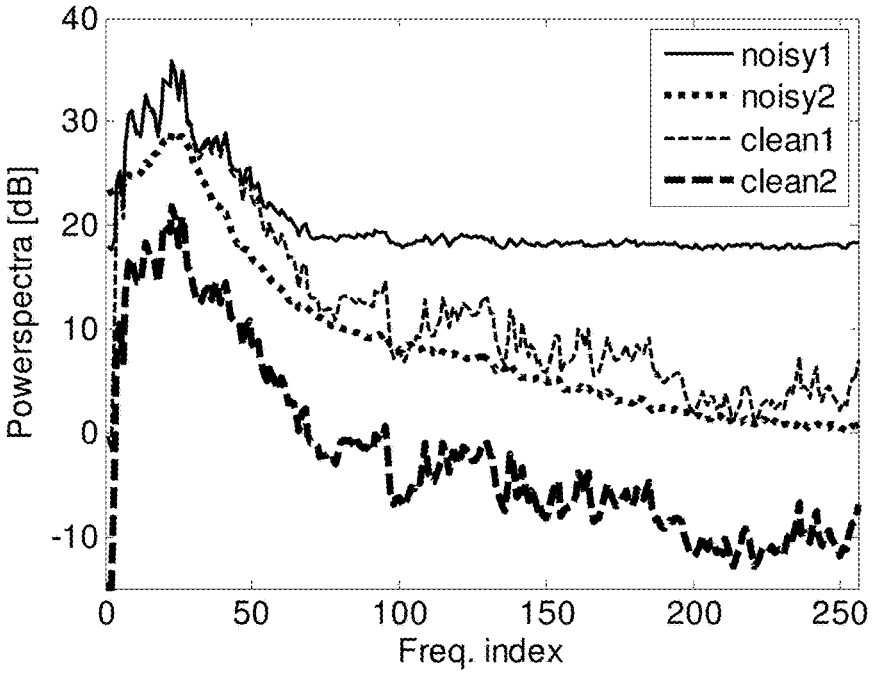
FIG. 1 illustrates an exemplary plot of clean and noisy spectra of primary and reference signals according to one embodiment.

The following description is of example embodiments of the invention only, and is not intended to limit the scope, applicability or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. It should be appreciated that the description herein may be adapted to be employed with alternatively configured devices having different shapes, components, mechanisms and the like and still fall within the scope of the present invention. Thus, the detailed description herein is presented for purposes of illustration only and not of limitation.

Reference in the specification to "one implementation" or "an embodiment" is intended to indicate that a particular feature, structure, or characteristic described is included in at least an embodiment, implementation or application of the invention. The appearances of the phrase "in one implementation" or "an embodiment" in various places in the specification are not necessarily all referring to the same implementation or embodiment.

1 Modeling Assumptions and Definitions

1.1 Signal Model

The time-domain signals coming from the two microphones are called $y_1$ for the primary microphone and $y_2$ for the secondary (reference) microphone. The signals are the sum of a speech signal and a noise disturbance $$y_i(n)=s_i(n)+d_i(n), i=1,2, \tag{1}$$

where n is the discrete time index. On a phone, the secondary microphone is usually located on the back and the user talks into the primary microphone. The primary speech signal is therefore often much stronger than the secondary speech signal. The noise signals are often of similar strength, but frequency dependent level differences can exist, depending on the locations of the noise sources and differences in microphone sensitivities. It is assumed that the noise and speech signals in a microphone are independent.

The vast majority of speech enhancement algorithms operate in the FFT domain, where the signals are $$Y_i(k,m)=S_i(k,m)+D_i(k,m), \tag{2}$$

where k is the discrete frequency index and m=0, 1, . . . is the frame index.

The primary and reference signals can be the "raw" microphone signals or they can be the microphone signals after some kind of preprocessing. Many preprocessing algorithms are possible. For example, the preprocessing could consist of fixed filters that attenuate certain bands of the signals, or it could consist of algorithms that try to attenuate the noise in the primary signal and/or the speech in the reference channel. Examples of the this type of algorithms are beamforming algorithms and adaptive filters, such as least mean square filters and Kalman filters.

Spectral speech enhancement consists of applying a gain function G(k, m) to each noisy Fourier coefficient $Y_1(k, m)$, see, e.g., [1-5]. The gain applies more suppression to frequency bins with lower SNR. The gain is time varying and has to be determined for every frame. The gain is a function of two SNR parameters of the primary channel: the prior SNR $\xi_1(k, m)$ and the posterior SNR $\gamma_1(k, m)$, that are defined as $$\xi_1(k, m) = \frac{\lambda_{s1}(k, m)}{\lambda_{d1}(k, m)}, \text{ and} \tag{3}$$

$$\gamma_1(k, m) = \frac{|Y_1(k, m)|^2}{\lambda_{d1}(k, m)}, \tag{4}$$

respectively, where $\lambda_{s1}(k, m)$ and $\lambda_{d1}(k, m)$ are the spectral variances of primary speech and noise signals, respectively.

The indices k and m may be omitted for ease of notation with the understanding that signals and variables in the FFT domain are frequency dependent and may change from frame to frame.

The spectral variances are defined as the expected values of the squares of the magnitudes:

$$\lambda_{si}(k,m)=\varepsilon\{|S_i(k,m)|^2\},\lambda_{di}(k,m)=\varepsilon\{|D_i(k,m)|^2\}. \tag{5}$$

ε is the expectation operator.

The spectral variances $\lambda_{s1}$ and $\lambda_{d1}$, are estimates. For independent speech and noise signals, the spectral variances of the noisy signals $\lambda_{yi}$ are the sum of the speech and noise spectral variances.

2 Estimation of SNRs

The estimation of the prior and posterior SNR of the primary channel requires estimation of $\lambda_{s1}$ and $\lambda_{d1}$. A simple way to estimate $\lambda_{d1}$ is to use the reference channel. Assuming that the noise signals in both microphones have about the same strength and that the speech signal in the reference channel is weak compared to the noise signal, an estimate of $\lambda_{d2}$ may be obtained by means of exponential smoothing of the signal powers $|Y_2^2|$, and use that as the estimate of $\lambda_{d1}$ as well.

$$\hat{\lambda}_{d2}(k,m)=\alpha_{NV}\hat{\lambda}_{d2}(k,m-1)+(1-\alpha_{NV})|Y_2(k,m)|^2, \tag{6}$$

where $\alpha_{NV}$ is the Noise Variance smoothing factor.

This simplified estimator can present some issues. As mentioned before, the noise signals may have different levels in both channels. This will result in suboptimal filtering. Furthermore, the microphone often picks up some of the target speech in the reference signals. This means that the estimator (6) will overestimate the noise level. This may result in oversuppression of the primary speech signal. The next sections address proposed methods to deal with these issues.

Given an estimate of the noise variance, the prior SNR of the primary channel is commonly estimated by means of the "decision-directed approach", e.g., $$\hat{\xi}_1(k, m) = \max\left(\alpha_{XI}\frac{\hat{A}_1^2(k, m-1)}{\hat{\lambda}_{d1}(k, m)} + (1-\alpha_{XI})(\hat{\gamma}_1(k, m)-1), \xi_{min}\right), \tag{7}$$

with $\alpha_{XI}$ the prior SNR smoothing factor, $\hat{A}_1(k, m-1)$ the estimated primary speech spectral magnitudes from the previous frame, and $\hat{\gamma}_1=|Y_1|^2/\hat{\lambda}_{d1}$ the estimated posterior SNR.

3 Estimation of Power Level Differences

The difference in signals in the FFT domain can be modeled with factors $C_s(k, m)$ and $C_d(k, m)$. These frequency dependent coefficients are introduced to describe the average difference in speech or noise levels in the two microphones. They can change over time, but their magnitudes are assumed to change at a much slower rate than the frame rate. The signal model in the FFT domain now becomes $$Y_1(k,m)=S(k,m)+C_d(k,m)N_1(k,m),$$

$$Y_2(k,m)=C_s(k,m)S(k,m)+N_2(k,m). \tag{8}$$

The noise terms $N_1$ and $N_2$ contain contributions from all the noise sources. Their variance is assumed to be equal, but the squared magnitude of $C_d$ models the average power level difference between the actual noise signals. $C_d$ is thus called the Noise Power Level Difference (NPLD) coefficient. Likewise, $C_s$ is called the Speech Power Level Difference (SPLD) coefficient. The Power Level Difference (PLD) coefficients are assumed complex in order to model any long-term average phase differences that may exist. The phase of $C_d$ is expected to vary much faster than that of $C_s$, because of the following reasons. All noise sources are at different relative positions with regard to the microphones. These noise sources are possibly moving relative to the speaker and to each other and there can also be reverberation.

These factors are likely less important for the speech signal, because it is assumed one target speaker is close to the microphones. An important contribution to the phase of $C_s$ is the delay in signal arrival times. Usually the absolute value of $C_s$ is smaller than 1 ($|C_s|<1$). The absolute value of $C_d$ can be both smaller and larger than 1. $C_s(k, m)$ and the absolute value $|C_d(k, m)|$ are assumed to change gradually (otherwise it becomes difficult to estimate them accurately).

Assuming independent speech and noise, the spectral variances of the noisy signals are modeled by $$\lambda_{y1}(k,m)=\lambda_s(k,m)+|C_d(k)|^2\lambda_d(k,m), \tag{9}$$

$$\lambda_{y2}(k,m)=|C_s(k)|^2\lambda_s(k,m)+\lambda_d(k,m). \tag{10}$$

Note that the frame index m was omitted from the PLD coefficients, since it is assumed that their magnitudes remain almost constant during the length of a frame. It is assumed that the variances of $N_1$ and $N_2$ are both equal to $\lambda_d$. The NPLD is described by $|C_d|^2$ and the SPLD by $|C_s|^2$.

Derivation of Maximum Likelihood estimators of $|C_d|$ and of $C_s$ is explained below.

3.1 Estimation of the NPLD

Suppose $C_dN_1$ is known. If a speech FFT coefficient is modeled by a complex Gaussian distribution with mean 0 and variance $\lambda_s$, then the Probability Density Function (PDF) of a noisy FFT coefficient given the value of $C_dN_1$ is complex Gaussian with mean $C_dN_1$ and variance $\lambda_s$ $$p(Y_1 \mid C_dN_1) = \frac{1}{\pi\lambda_s}\exp\left\{-\frac{|Y_1 - C_dN_1|^2}{\lambda_s}\right\}. \tag{11}$$

Equation (11) can also be written as $$p(Y_1 \mid C_dN_1) = \frac{1}{\pi\lambda_s}\exp\left\{-\frac{|Y_1|^2 + |C_dN_1|^2 - 2|C_d||N_1|\cos\{\theta - \psi\}}{\lambda_s}\right\}, \tag{12}$$

where $\theta$ is the phase of $Y_1$ and $\psi$ is the phase of $C_dN_1$. Maximum Likelihood (ML) estimation theory [6] dictates that maximizing the PDF with regard to the unknown parameters leads to estimates with certain desirable properties. For example, the variance of the estimator approaches the Cramér-Rao lower bound as the number of observations increases. To reduce the variance to an acceptable level, the estimation has to be based on data from multiple frames. The speech FFT coefficients S(k, m) of consecutive frames may be assumed to be independent. This is a simplifying assumption that is often made in the speech enhancement literature. The joint PDF of the noisy FFT coefficients $Y_1(k, m)$ of multiple frames, given the $C_d(k, m)$ $N_1(k, m)$, can then be written as the product of the PDFs (12) of these frames. The resulting joint PDF for frequency index k for M consecutive frames is modeled as $$p(Y_1(k) \mid N'_1(k)) = \prod_{m=1}^{M} \frac{1}{\pi\lambda_s(k, m)}\exp\left\{-\frac{|Y_1(k, m) - C_d(k, m)N_1(k, m)|^2}{\lambda_s(k, m)}\right\}. \tag{13}$$

$Y_1(k)$ is a vector of noisy FFT coefficients of M consecutive frames. $N'_1(k)$ is a vector of consecutive $C_d(k, m)$ $N_1(k, m)$ coefficients.

It will be assumed that the phases (k, m) are independent of each other for consecutive frames. The PDF (12) is maximized with regard to $\psi(k, m)$ for $\psi(k, m)=\theta(k, m)$, that is, the ML estimates of the phases of $N'_1(k)$ equal the noisy phases. Substituting these estimates into the joint PDF (13) and maximizing with regard to $|C_d(k)|$, yields the following expression for its ML estimate $$|\hat{C}_d(k)| = \sum_{m=1}^{M} \frac{|Y_1(k, m)||N_1(k, m)|}{\lambda_s(k, m)} \Big/ \sum_{m=1}^{M} \frac{|N_1(k, m)|^2}{\lambda_s(k, m)}. \tag{14}$$

Thus both the numerator and denominator of (14) are normalized by $\lambda_s(k, m)$. This means that frames with a lot of speech energy are given little weight. In theory this means that $|\hat{C}_d(k)|$ can be estimated also during periods of high SNR, although better estimates are to be expected when the speech signal has low SNR. Notably that speech presence has been assumed in the derivation of this estimator.

Although the use of a Gaussian speech model is common, supergaussian statistical models have also been proposed. See for example [7-9] and the references therein. In theory, ML estimators for the NPLD can also be derived for these models. The estimator based on the Gaussian model already works quite well, and is used here.

Note that the estimator (14) assumes that there is at least some speech in all of the frames ($\lambda_s(k, m)\neq 0$). Thus the normalization factors are limited to prevent division by a very small number. Through experimentation it was observed that the following normalizations work quite well. One can estimate $\lambda_s$ by multiplying the prior SNR of the primary channel by the noise variance. The prior SNR was computed using decision-directed approach where the noise variance estimates $\tilde{\lambda}_{d1}(k, m)$ were provided by the data-driven noise tracking algorithm [10] and the speech spectral magnitudes $\tilde{A}_1(k, m)$ were estimated using the Wiener gain.

Another possibility is to use squared spectral magnitude estimates, for example $\tilde{A}_1^2(k, m)$, as rough estimates of the speech spectral variances. It is advisable to smooth them a bit over time, to reduce the variance and avoid very small values.

These two alternative speech variance estimates are large when speech is present, and they are roughly proportional to the noise variance in noise-only segments.

In pure noise, the PDF of $Y_1$ can be modeled as complex gaussian with variance $|C_d|^2\lambda_d$. An ML estimator for noise-only periods would look like $$|\hat{C}_d(k)|^2 = \frac{1}{M}\sum_{m=1}^{M} \frac{|Y_1(k, m)|^2}{\lambda_d(k, m)}. \tag{15}$$

This estimator requires a Voice Activity Detector (VAD). In the current implementation (14) is used in estimating the denominator $\lambda_d$. Although the summation over m suggest the use of a segment of consecutive data values, this is not required. For example, one could choose to use only data from frames where a VAD indicates speech absence. Alternatively, some contributions in the summation could be given less weight, depending for example on an estimate of speech presence probability.

The averages in the numerator and denominator are computed by means of exponential smoothing. This allows for tracking slow changes in $|C_d(k)|$. For example, if the numerator of (14) is called B(k, m), then it is updated as follows $$B(k, m) = \alpha_{NPLD}(k, m)B(k, m-1) + (1 - \alpha_{NPLD}(k, m))\frac{|Y_1(k, m)||\tilde{N}(k, m)|}{\tilde{\lambda}_s(k, m)}, \tag{16}$$

where $\tilde{\lambda}_s(k, m)=\tilde{\xi}_1(k, m)\tilde{\lambda}_{d1}(k, m)$ are the estimated speech spectral variances. The denominator of (14) is updated similarly. The $|\tilde{N}(k, m)|$ are estimates of the noise spectral magnitudes. The estimator (14) depends on the noise magnitudes $|N_1(k, m)|$ and these are not known. The data-driven noise tracker provides the estimates $|\tilde{N}(k, m)|$ and these are used in the implementation (16). Those of the reference channel are used, since noise magnitudes are more reliably estimated from the reference channel than from the primary channel when speech is present. This assumes $|N_1(k, m)|\approx|N_2(k, m)|$.

To further control the weight given to different frames smoothing factors $\alpha_{NPLD}$ are applied that depend on a rough estimate of speech presence probability. These smoothing factors are found from those provided by the data-driven noise tracking algorithm [10], as follows $$\alpha_{NPLD}(k,m)=\max(\alpha_{s2}(k,m),0.98^{T_s/16}), \tag{17}$$

where $\alpha_{s2}$ is the smoothing factor provided by the data-driven noise tracker for the reference channel, and $T_s$ is the frame skip in ms. The smoothing factors $\alpha_{s2}(k, m)$ are closer to 1 when it is more likely that speech is present in the reference channel, resulting in slower updating of the statistics.

In experiments it was noticed that the NPLD estimator is biased low, i.e., it underestimates the NPLD somewhat. Part of the reason is that the data-driven noise tracker provides MMSE estimates of $|N(k, m)|^2$, and the square root of those is used in (16). The square root operator introduces some bias, although there can be other sources of bias as well. For example, estimates $|\tilde{N}_2(k, m)|$ obtained from the reference channel are used instead of from the primary channel, but the latter will in general be more strongly correlated with the noisy magnitudes $|Y_1(k, m)|$ of the primary channel. To compensate for the observed bias, (16) can be multiplied by an empirical bias correction factor $\eta$. An appropriate value of $\eta$ is in the range of 1 to 1.4.

3.2 Estimation of the SPLD Coefficient

To derive an estimator of $C_s$, (8) can be rewritten in the form $$Y_2(k,m)=C_s(k)Y_1(k,m)+\{N_2(k,m)-C_s(k)C_d(k,m)N_1(k,m)\}. \tag{18}$$

The phase of $C_d$ is expected to be more or less random, and $C_s$ is independent of the noise. Then the two terms between the braces are independent. Their sum is denoted as $N'(k, m)$ and is modeled as complex Gaussian noise with variance $$\lambda'_d(k,m)=\lambda_d(k,m)\{1+|C_s(k)|^2|C_d(k)|^2\}=\lambda_2(k,m)\{1+\beta(k)\}, \tag{19}$$

where $\beta(k)=|C_s(k)|^2|C_d(k)|^2$. Usually $\beta$ is smaller than 1. Similarly to what was done in deriving the NPLD estimator (14), the joint PDF $P(Y_2|Y'_1)$ can be maximized, where $Y'_1$ is the vector of $C_s(k)Y_1(k, m)$ values. Maximizing this PDF is equivalent to minimizing minus the natural logarithm of it, the relevant part of which is $$\sum_{m=1}^{M}\left\{\log\lambda'_d(k,m)+\frac{|Y_2(k,m)-C_s(k,m)Y_1(k,m)|^2}{\lambda'_d(k,m)}\right\}. \tag{20}$$

Because $\lambda'_d$ depends on $C_s$, I could not find a closed-form solution for the value of $C_s$ that maximizes the PDF. If $\lambda'_d$ did not depend on $C_s$, the minimum of the (summed) quotient would be found for $$\hat{C}_s(k,m)=\sum_{m=1}^{M}\frac{Y_2(k,m)Y_1^*(k,m)}{\lambda'_d(k,m)}\Big/\sum_{m=1}^{M}\frac{|Y_1(k,m)|^2}{\lambda'_d(k,m)}. \tag{21}$$

Note that this estimator is complex valued, i.e., both magnitude and phase are estimated.

Since $\lambda'_d$ is monotonically increasing with $|C_s|$, the actual minimum of the summed quotient in (20) lies at a value with a somewhat larger absolute value than $|\hat{C}_s|$ from (21). On the other hand, the term $\lambda'_d$ itself in (20) pulls the location of the minimum to a value with a somewhat smaller absolute value. These effects may partly compensate. These effects are also expected to be small when $\beta$ is small. Therefore I used (21) as the estimator for $C_s$.

As with the NPLD estimator, the numerator and denominator are updated by means of exponential smoothing. Here a smoothing factor is needed that is closer to 1 when it is more likely that only noise is present. Such a smoothing factor can be found from the one $\alpha_{s1}$ provided by the data-driven noise tracking algorithm for the primary channel. The smoothing factor $\alpha_{SPLD}$ is computed from $\alpha_{s1}$ as $$\alpha_{SPLD}(k,m)=\max(1+0.85^{T_s/16}-\alpha_{s1}(k,m),0.98^{T_s/16}). \tag{22}$$

The minimum attainable value of $\alpha_{s1}$ is $0.85^{T_s/16}$ (desired in noise only periods) for which $\alpha_{SPLD}=1$. Note, The neural network VAD could be useful in noise only periods, for example, by forgoing an update when the VAD indicates the absence of speech.

$\lambda'_d$ is calculated from the noise variance estimates provided by the data-driven noise tracker as follows $$\lambda'_d(k,m)=|\hat{C}_s(k)|^2\tilde{\lambda}_{d1}(k,m)+\tilde{\lambda}_{d2}(k,m), \tag{23}$$

where $\tilde{\lambda}_{d1}$ and $\tilde{\lambda}_{d2}$ are the data-driven noise variance estimates for the primary and reference channel, respectively. $\hat{C}_s$ is the estimate of $C_s$ from the previous frame. So first (23) is calculated and that value is used to update the statistics in (21) to calculate a new estimate of $C_s$.

3.2.1 Empirical Estimators

From the data-driven noise variance estimates $\tilde{\lambda}_{d1}$ and $\tilde{\lambda}_{d2}$ also some empirical estimators can be constructed. For example, the ratio of $$\bar{\lambda}_{d1}(k,m)=\alpha_d\bar{\lambda}_{d1}(k,m-1)+(1-\alpha_d)\tilde{\lambda}_{d1}(k,m), \text{ and}$$

$$\bar{\lambda}_{d2}(k,m)=\alpha_d\bar{\lambda}_{d2}(k,m-1)+(1-\alpha_d)\tilde{\lambda}_{d2}(k,m) \tag{24}$$

is such an estimator of $|C_d|^2$. A suitable value for the smoothing parameter $\alpha_d$ is $0.95^{T_s/16}$. An empirical estimator of the SPLD can be constructed by taking the ratio of $$\bar{\lambda}_{s2}(k,m)=\alpha_{SPLD}\bar{\lambda}_{s2}(k,m-1)+(1-\alpha_{SPLD})\{|Y_2(k,m)|\tilde{N}_2(k,m)|\}^2, \text{ and}$$

$$\bar{\lambda}_{s1}(k,m)=\alpha_{SPLD}\bar{\lambda}_{s1}(k,m-1)+(1-\alpha_{SPLD})\{|Y_1(k,m)|\tilde{N}_1(k,m)|\}^2, \tag{25}$$

where $|\tilde{N}_1|$ and $|\tilde{N}_2|$ are provided by the data-driven noise tracker. This estimator has the advantage that it is phase independent, but it was found that it performs less well at low SNRs than the estimator based on (21).

4 Some Examples

In this section some results with artificial and measured noise signals will be shown to illustrate the performance of the PLD estimators (14) and (21). For the first example, an artificial dual-channel signal is constructed. The primary clean speech signal is a TIMIT sentence (sampled at 16 kHz), normalized to unit variance. Silence frames are not removed. The secondary channel is the same signal divided by 5. This corresponds to an SPLD of $20*\log_{10}(1/5)=14$ dB. The noise in the primary channel is white noise, and the noise in the reference channel is speech-shaped noise, obtained by filtering white noise with an appropriate all-pole filter. Both noise signals are first normalized to unit variance and then scaled with the same factor, such that the SNR in the primary channel equals 5 dB. FIG. 1 shows the average spectra of the clean and noisy signals. The average primary speech spectrum is stronger than the noise spectrum in the lower frequency range, but not in the higher frequency range. The average reference speech spectrum is much weaker than the noise spectrum.

Figure 2:
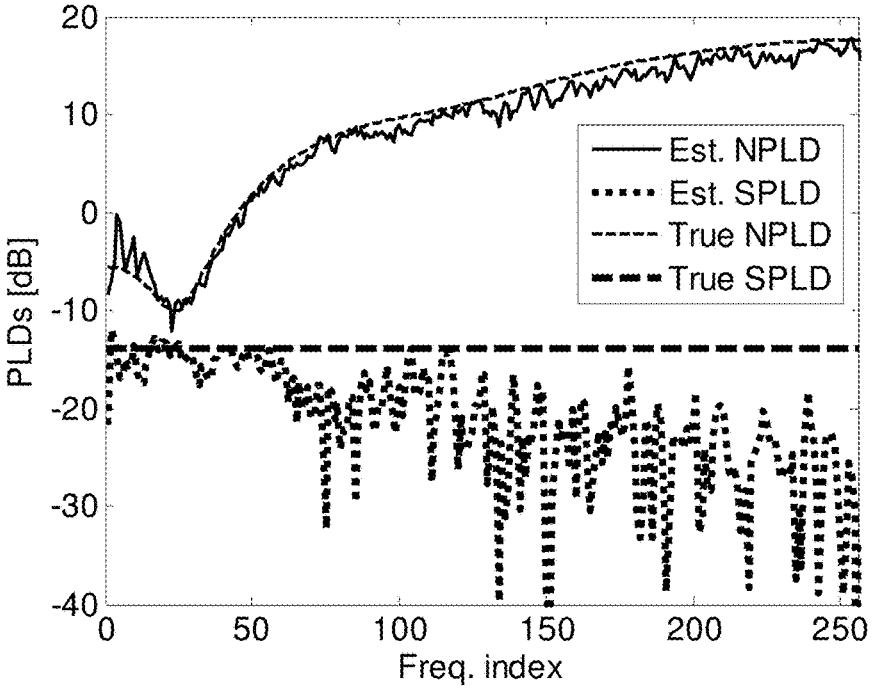
FIG. 2 illustrates estimated and true NPLD and SPLD spectra for the signals of FIG. 1.

FIG. 2 shows the true and estimated NPLD and SPLD spectra. White noise at SNR=5 dB is used for the primary signal, speech-shaped noise with equal variance for the reference signal. A bias correction factor $\eta=1.2$ was used. The NPLD is quite accurately estimated, except for the lowest frequencies where the average speech spectrum has very high SNR. The SPLD is quite well estimated in the lower frequency range, even though the speech in the reference channel is much weaker than the noise. It is underestimated in the higher frequency regions where both channels are swamped by the noise.

The next example uses measured dual-microphone noise. Real-life noises very often have lowpass characteristics.

Figure 3:
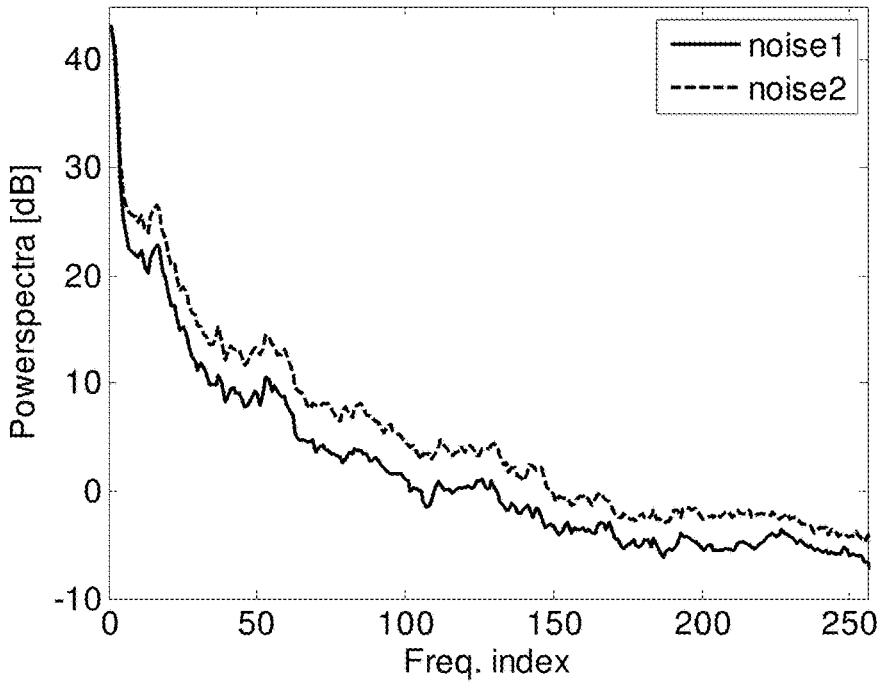
FIG. 3 illustrates the average spectrum from both channels of measured noise in a simulated cafe environment.

FIG. 3 shows the average spectrum for both channels of measured cafe noise. The microphones were spaced 10 cm apart. Both signals were normalized to unit standard deviation. For most frequencies the noise was observed to be somewhat louder in the reference channel. This noise was computer-mixed with a sentence from the MFL database at an SNR of 0 dB (in the primary channel).

Figure 4:
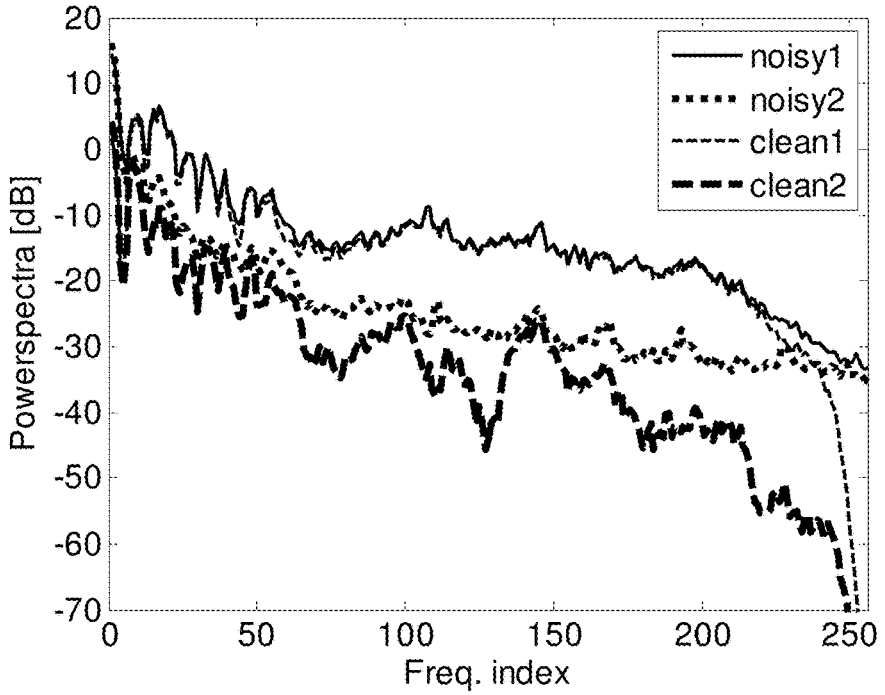
FIG. 4 illustrates the average spectra of the clean and noisy signals in the simulated cafe environment scenario of FIG. 3.

FIG. 4 shows the average spectra of the clean and noisy signals. Dual microphone cafe noise was used at an SNR of 0 dB in the primary channel. It can be seen that the noise dominates the speech in both channels in the very low frequency range.

Figure 5:
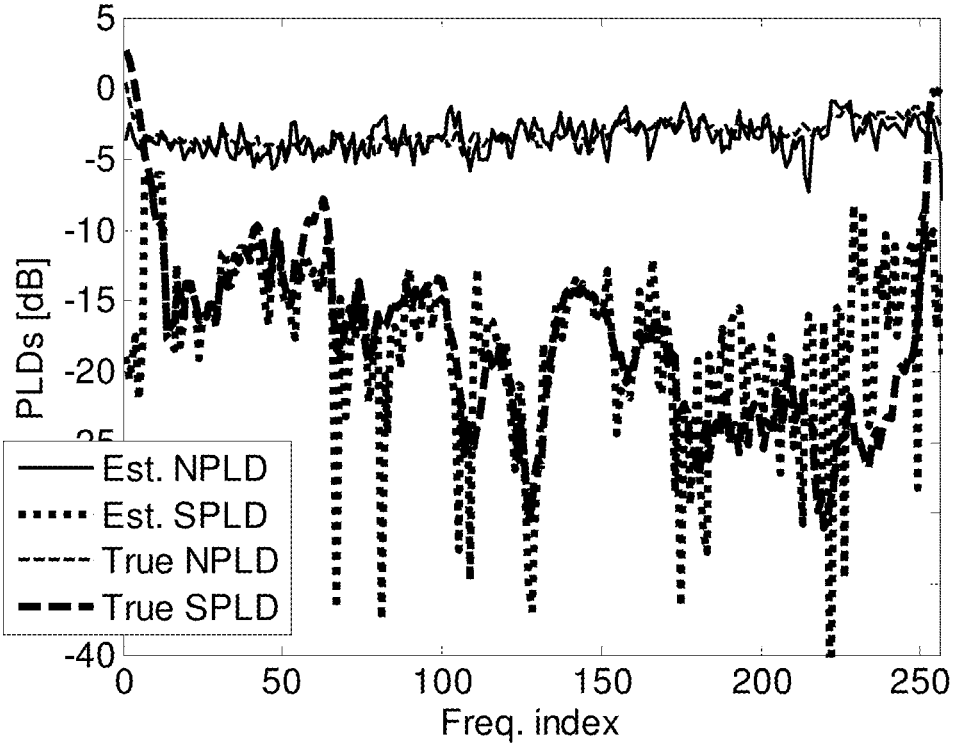
FIG. 5 illustrates the measured "true" and estimated NPLD and SPLD spectra for the signals of FIG. 1.

FIG. 5 shows the measured ("true") and estimated PLD spectra for the noisy signals of FIG. 4. The measured PLD spectra are obtained from the ratios of the average noise or speech spectra of both channels. It can be seen that the estimated and true measured PLD spectra match quite well. The SPLD estimates are inaccurate for the lowest frequencies where the noise dominates the speech in both channels, and for the highest frequencies where there is very little speech energy.

The lowpass characteristics of many natural noise sources will make it often very difficult in practice to accurately estimate the SPLD in the very low frequency range. For this reason, in the actual implementation, the estimator (21) was not used for the frequencies below 300 Hz. Instead, the average of the estimated SPLD spectrum is used for a limited range of frequencies above 300 Hz. An appropriate frequency range for averaging is 300-1500 Hz for example, where the speech signal is strong (especially in voiced speech).

5 Applying PLD Corrections

5.1 Correction of the Noise Variance

The main reason for delving into the problem of NPLD and SPLD estimation was improving the noise variance estimates (6) obtained from the reference channel. The NPLD and SPLD spectra can be used to calculate corrections to (6) that should make it closer to the noise variance in the primary channel. In cases where the speech signal in the reference channel is very weak, it would suffice to apply an NPLD correction only. The NPLD correction can be easily implemented by multiplying (6) with the estimated NPLD spectrum.

The speech signal in the reference channel can be stronger sometimes than the noise in certain frequency bands, depending on factors like noise type, voice type, SNR, noise source location, and phone orientation. In that case (6) will overestimate the noise level, potentially causing significant speech distortions in the MMSE filtering process. There are many ways in which an additional correction for the speech power can be made. Through experimentation it was found that the following method works well.

From (9) it can be seen that the prior SNR of channel 1, $\xi_1$, equals $\lambda_s/|C_d|^2\lambda_d$. Likewise, (10) shows that the prior SNR of channel 2, $\xi_2$, equals $|C_s|^2\lambda_s/\lambda_d$. Therefore, the following relation exists between these prior SNRs $$\xi_2(k,m)=|C_s(k)|^2|C_d(k)|^2\xi_1(k,m)=\beta(k)\xi_1(k,m). \tag{26}$$

Multiplying (10) by $|C_d|^2$ and dividing by $1+\xi_2=1+\beta\xi_1$ makes it equal to the noise variance term $|C_d|^2\lambda_d$ of channel 1. So that is the desired correction to be made to (6). Since the prior SNR is updated in every time frame a correction to $|Y_2|^2$ is applied in the second term of (6), modifying it to $$\hat{\lambda}_{d2}(k,m) = \alpha_{NV}\hat{\lambda}_{d2}(k,m-1) + (1-\alpha_{NV})|Y_2(k,m)|^2\frac{1}{1+\beta(k)\hat{\xi}_1(k,m)}, \tag{27}$$

$$\hat{\lambda}_{d1}(k,m) = |C_d(k)|^2\hat{\lambda}_{d2}(k,m). \tag{28}$$

The corrections can be calculated from the estimated PLD spectra and the prior SNR (7) of channel 1. However, more is required. The prior SNR estimate $\hat{\xi}_1$ that we can use in (27) is found from e.g. (7), using the NPLD-corrected noise variance. Since no correction for the speech power has been applied yet to that noise variance estimate, it is an overestimate of the noise variance when speech is present. The resulting prior SNR estimate is therefore an underestimate. This means that dividing by $1+\beta\hat{\xi}_1$ in (27) will not fully correct for the speech energy. A more complete correction might be found by calculating the prior SNR (7) and noise variances (27), (28) iteratively.

Using an equation for prior SNR based on a fully corrected noise variance, a resulting equation for prior SNR can be obtained without many iterations. Substituting (27) into (28), the resulting expression for the PLD-corrected noise variance into (7), and leaving off the max operator, leads to a second order polynomial in $\hat{\xi}_1$, which is easy to solve. There may be 0, 1, or 2 positive real solutions.

If there is exactly 1 positive solution, it can be substituted into (27) to find the PLD corrected noise variance.

When there are 2 positive real solutions for prior SNR, the smallest one will be used. This situation may occur when (7), without the max operator, is negative. Since this usually corresponds to a very low SNR situation, the smallest solution to the quadratic equation is chosen.

When there is not any positive real solution, the "incomplete" correction is used, that is, the NPLD correction is applied to (6), prior SNR is calculated from (7), and that is used in (27).

An alternative correction method considered was based on smoothing of the signal powers in both primary and reference channel, as shown in (6) for the reference channel. Each channel variance estimate consists of a speech and a noise component, with relative strengths described, on the average, by the NPLD and SPLD. One can solve for the noise component. The resulting estimator has a rather large variance and can even become smaller than zero, for which counter measures have to be taken. Thus, in some cases the correction method described below (27), (28) may be preferable.

The correction techniques described above improve both objective quality (in terms of PESQ, SNR and attenuation) and subjective quality when tested on several different data sets.

5.2 Modifying the Inter Level Difference Filter

The Inter Level Difference Filter (ILDF) multiplies the MMSE gains with a factor f that depends, in one embodiment, on the ratio of the magnitudes of primary and reference channel as follows $$f(k, m) = \frac{1}{1 + \exp\left\{\left(\tau - \frac{|Y1(k, m)|}{|Y2(k, m)|}\right)\sigma\right\}}, \tag{29}$$

where $\tau$ is the threshold of the sigmoid function and $\sigma$ its slope parameter. The ILDF tends to suppress residual noise. Stronger reference magnitudes relative to the primary magnitudes result in stronger suppression. For fixed parameters $\tau$ and $\sigma$, the filter will perform differently when the NPLD and SPLD change. It becomes easier to choose parameters that work well under a wide range of conditions when the NPLD and SPLD are taken into account. One way to do this is to apply the same PLD corrections as in (27) and (28) to the magnitudes of the reference channel, i.e., use $$|\tilde{Y}_2(k, m)| = |Y_2(k, m)| \frac{|C_d(k)|}{\sqrt{1 + \beta(k)\hat{\xi}_1(k, m)}} \tag{30}$$

in (29) instead of $|Y_2(k, m)|$.

Apart from PLD variations, more aggressive filtering may be applied in noise only frames than in frames that also contain speech. One way to achieve this is by making the threshold $\tau$ a function of the neural network VAD output $$\tau(V) = V\tau_S + (1 - V)\tau_N, \tag{31}$$

where V is the VAD output normalized to a value between 0 and 1, $\tau_S$ is the threshold we want to use in speech frames, and $\tau_N$ the threshold for noise frames. $\tau_S$=1 and $\tau_N$=1.5 were suitable for various experiments.

5.3 Other Applications

Apart from noise variance and postfilter corrections, the NPLD and SPLD could be useful in several other ways. Some speech processing algorithms are trained on signal features. For example, VADs and speech and speaker recognition systems. If multiple channels are used to compute the features, these algorithms may benefit in their application from PLD-based feature corrections. That is because such corrections may decrease the differences between the features seen in training and those faced in practice.

In some applications one may have the option to choose between several available microphones. The NPLD and SPLD may help in selecting the microphone(s) with the highest signal to noise ratio(s).

The NPLD and SPLD may also be used for microphone calibration. If the test signals entering the microphones are of equal strength, the NPLD or SPLD determine the relative microphone sensitivities.

6 Overview

Figure 6:
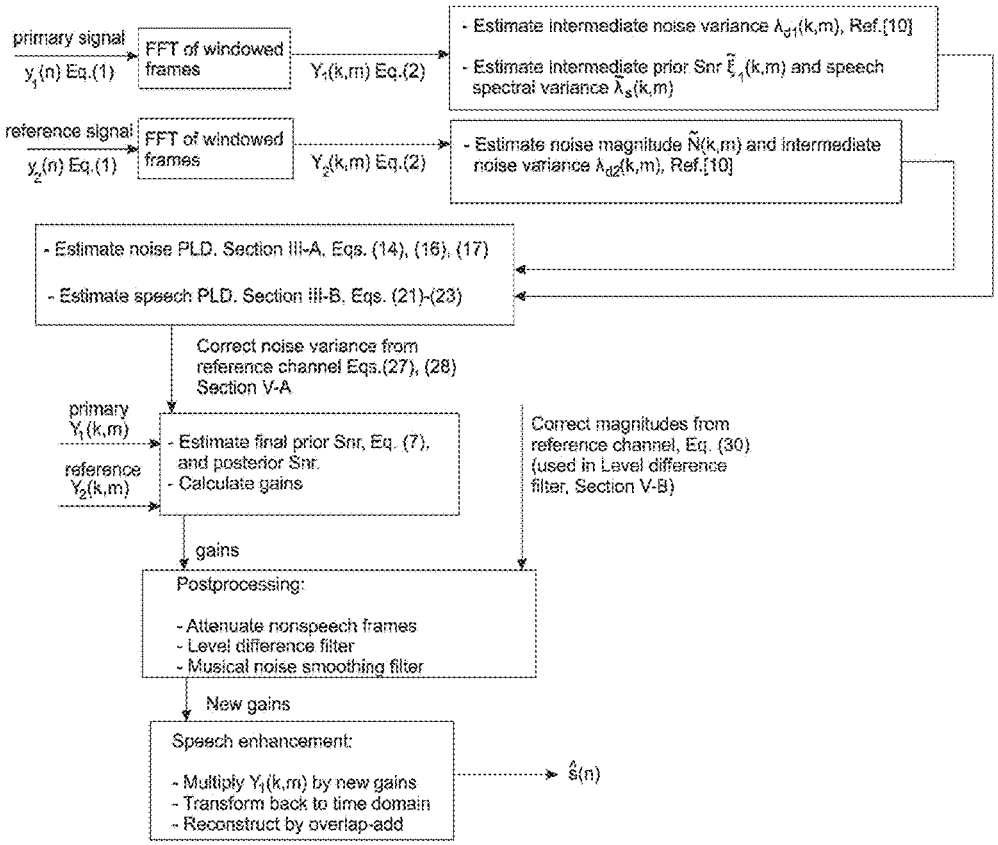
FIG. 6 illustrates a process flow overview for estimation of noise and speech power level differences for use in a spectral speech enhancement system according to one embodiment.

FIG. 6 shows an overview of the NPLD and SPLD estimation and correction procedures and how they fit into novel spectral speech enhancement system. NOTE:

Section III-A in the figure corresponds to Section 3.1 of this document.

Section III-B in the figure corresponds to Section 3.2 of this document.

Section V-A in the figure corresponds to Section 5.1 of this document.

Section V-B n the figure corresponds to Section 5.2 of this document.

Overlapping frames from the, possibly preprocessed, microphone signals $y_1(n)$ and $y_2(n)$ are windowed and an FFT is applied. The spectral magnitudes of the primary channel are used to make intermediate noise variance, prior SNR, and speech variance estimates. The spectral magnitudes of the reference channel are used to make noise magnitude and intermediate noise variance estimates.

From these quantities and the FFT coefficients of both channels the noise and speech PLD coefficients are estimated. The final noise variance estimates (27), (28) and prior SNR estimates are calculated according to Section V-A. Also the posterior SNR is computed and the MMSE gains.

In the postprocessing stage the MMSE gains are modified by an inter level difference filter, a musical noise smoothing filter, and a filter that attenuates nonspeech frames. The PLD corrections that have been applied to the reference magnitudes in the final noise variance estimates are used in the inter level difference filter as well.

In the reconstruction stage, the primary FFT coefficients are multiplied by the modified MMSE gains and the filtered coefficients are transformed back to the time domain. The clarified speech is constructed by an overlap-add procedure.

Embodiments of the present invention may also extend to computer program products for analyzing digital data. Such computer program products may be intended for executing computer-executable instructions upon computer processors in order to perform methods for analyzing digital data. Such computer program products may comprise computer-readable media which have computer-executable instructions encoded thereon wherein the computer-executable instructions, when executed upon suitable processors within suitable computer environments, perform methods of analyzing digital data as further described herein.

Embodiments of the present invention may comprise or utilize a special purpose or general-purpose computer including computer hardware, such as, for example, one or more computer processors and data storage or system memory, as discussed in greater detail below. Embodiments within the scope of the present invention also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media. Computer-readable media that carry computer-executable instructions are transmission media. Thus, by way of example, and not limitation, embodiments of the invention can comprise at least two distinctly different kinds of computer-readable media: computer storage media and transmission media.

Computer storage media includes RAM, ROM, EEPROM, CD-ROM or other optical disk storage, magnetic disk storage or other magnetic storage devices, or any other physical medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmission media can include a network and/or data links which can be used to carry or transmit desired program code means in the form of computer-executable instructions and/or data structures which can be received or accessed by a general purpose or special purpose computer. Combinations of the above should also be included within the scope of computer-readable media.

Further, upon reaching various computer system components, program code means in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or possibly primarily) make use of transmission media.

Computer-executable instructions comprise, for example, instructions and data which, when executed at a processor, cause a general purpose computer, special purpose computer, or special purpose processing device to perform a certain function or group of functions. The computer executable instructions may be, for example, binaries which may be executed directly upon a processor, intermediate format instructions such as assembly language, or even higher level source code which may require compilation by a compiler targeted toward a particular machine or processor. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Figure 7:
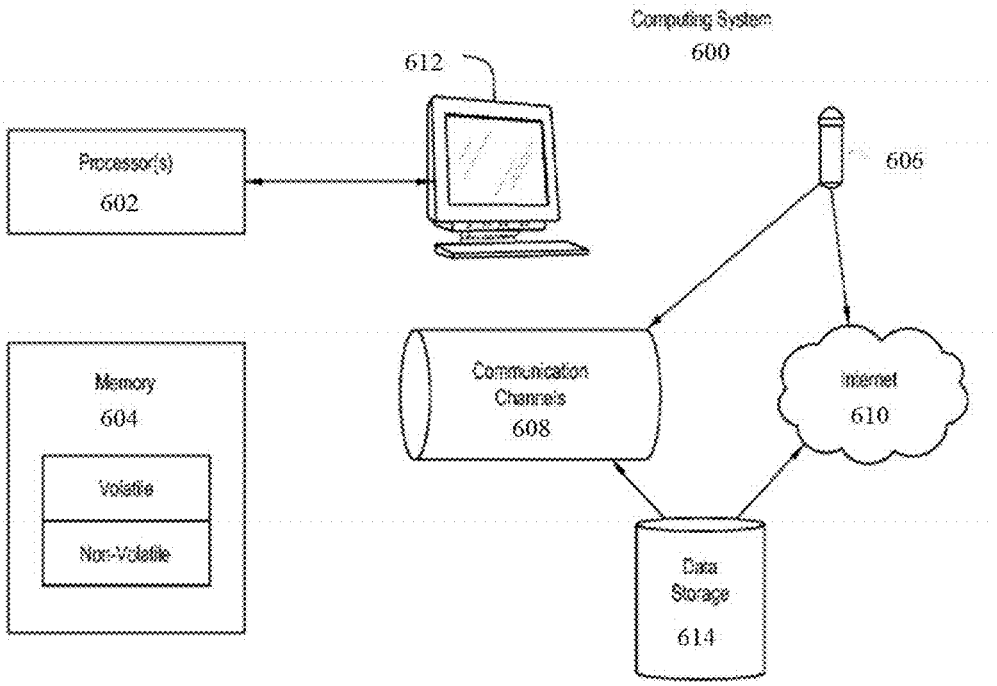
FIG. 7 illustrates a computer architecture for analyzing digital audio data.

With reference to FIG. 7 an example computer architecture 600 is illustrated for analyzing digital audio data. Computer architecture 600, also referred to herein as a computer system 600, includes one or more computer processors 602 and data storage. Data storage may be memory 604 within the computing system 600 and may be volatile or non-volatile memory. Computing system 600 may also comprise a display 612 for display of data or other information. Computing system 600 may also contain communication channels 608 that allow the computing system 600 to communicate with other computing systems, devices, or data sources over, for example, a network (such as perhaps the Internet 610). Computing system 600 may also comprise an input device, such as microphone 606, which allows a source of digital or analog data to be accessed. Such digital or analog data may, for example, be audio or video data. Digital or analog data may be in the form of real time streaming data, such as from a live microphone, or may be stored data accessed from data storage 614 which is accessible directly by the computing system 600 or may be more remotely accessed through communication channels 608 or via a network such as the Internet 610.

Communication channels 608 are examples of transmission media. Transmission media typically embody computer-readable instructions, data structures, program modules, or other data in a modulated data signal such as a carrier wave or other transport mechanism and include any information-delivery media. By way of example, and not limitation, transmission media include wired media, such as wired networks and direct-wired connections, and wireless media such as acoustic, radio, infrared, and other wireless media. The term "computer-readable media" as used herein includes both computer storage media and transmission media.

Embodiments within the scope of the present invention also include computer-readable media for carrying or having computer-executable instructions or data structures stored thereon. Such physical computer-readable media, termed "computer storage media," can be any available physical media that can be accessed by a general purpose or special purpose computer. By way of example, and not limitation, such computer-readable media can comprise physical storage and/or memory media such as RAM, ROM, EEPROM, CD-ROM or other optical disk storage, magnetic disk storage or other magnetic storage devices, or any other physical medium which can be used to store desired program code means in the form of computer-executable instructions or data structures and which can be accessed by a general purpose or special purpose computer.

Computer systems may be connected to one another over (or are part of) a network, such as, for example, a Local Area Network ("LAN"), a Wide Area Network ("WAN"), a Wireless Wide Area Network ("WWAN"), and even the Internet 110. Accordingly, each of the depicted computer systems as well as any other connected computer systems and their components, can create message related data and exchange message related data (e.g., Internet Protocol ("IP") datagrams and other higher layer protocols that utilize IP datagrams, such as, Transmission Control Protocol ("TCP"), Hypertext Transfer Protocol ("HTTP"), Simple Mail Transfer Protocol ("SMTP"), etc.) over the network.

Other aspects, as well as features and advantages of various aspects, of the disclosed subject matter should be apparent to those of ordinary skill in the art through consideration of the disclosure provided above, the accompanying drawings and the appended claims.

Although the foregoing disclosure provides many specifics, these should not be construed as limiting the scope of any of the ensuing claims. Other embodiments may be devised which do not depart from the scopes of the claims. Features from different embodiments may be employed in combination.

Finally, while the present invention has been described above with reference to various exemplary embodiments, many changes, combinations and modifications may be made to the embodiments without departing from the scope of the present invention. For example, while the present invention has been described for use in speech detection, aspects of the invention may be readily applied to other audio, video, data detection schemes. Further, the various elements, components, and/or processes may be implemented in alternative ways. These alternatives can be suitably selected depending upon the particular application or in consideration of any number of factors associated with the implementation or operation of the methods or system. In addition, the techniques described herein may be extended or modified for use with other types of applications and systems. These and other changes or modifications are intended to be included within the scope of the present invention.

BIBLIOGRAPHY

The following references are incorporated herein by reference in their entireties.

1. Y. Ephraim and D. Malah, "Speech enhancement using a minimum mean-square error short-time spectral amplitude estimator," *IEEE Trans. Acoust., Speech, Signal Proc.*, vol. ASSP-32, no. 6, pp. 1109-1121, December 1984.
2. J. Benesty, S. Makino, and J. Chen (Eds.), *Speech Enhancement*. Springer, 2005.
3. Y. Ephraim and I. Cohen, "Recent advancements in speech enhancement," in *The Electrical Engineering Handbook*. CRC Press, 2006.
4. P. Vary and R. Martin, *Digital Speech Transmission*. John Wiley & Sons, 2006.
5. P. C. Loizou, Speech Enhancement. *Theory and Practice*. CRC Press, 2007.
6. "Maximum likelihood," http://en.wikipedia.org/wiki/Maximum_likelihood.
7. R. Martin, "Speech enhancement based on minimum mean-square error estimation and supergaussian priors," *IEEE Trans. Speech, Audio Proc.*, vol. 13, no. 5, pp. 845?856, September 2005.
8. J. S. Erkelens, R. C. Hendriks, R. Heusdens, and J. Jensen, "Minimum mean-square error estimation of discrete Fourier coefficients with generalized Gamma priors," *IEEE Trans. Audio, Speech and Lang. Proc.*, vol. 15, no. 6, pp. 1741-1752, August 2007.
9. J. S. Erkelens, R. C. Hendriks, and R. Heusdens, "On the estimation of complex speech DFT coefficients without assuming independent real and imaginary parts," *IEEE Signal Proc. Lett.*, vol. 15, pp. 213-216, 2008.
10. J. S. Erkelens and R. Heusdens, "Tracking of nonstationary noise based on data-driven recursive noise power estimation," *IEEE Trans. Audio, Speech and Lang. Proc.*, vol. 16, no. 6, pp. 1112-1123, August 2008.

What is claimed:

1. A method for minimizing a noise power level difference (NPLD) between a primary channel and a reference channel of an audio device, comprising:

receiving, by a primary channel, an audio signal that has a speech signal level and a noise signal level;

receiving, by a reference channel, the audio signal with another speech signal level and another noise signal level;

estimating the noise signal level in the primary channel and the another noise signal level in the reference channel;

modeling respective probability density functions (PDFs) for transform coefficients for each of the primary channel and the reference channel of the audio signal;

using the respective primary channel and reference channel PDFs in correcting for a difference between the estimated noise signal level and the estimated another noise signal level by minimizing a noise power level difference NPLD between the primary channel and the reference channel; and calculating a corrected noise signal level of the reference channel based on the NPLD.

2. The method of claim 1, further comprising estimating the another speech signal level for the reference channel for one or more frequencies;

estimating the speech signal level for the primary channel for the one or more frequencies;

estimating a speech power level difference (SPLD) between the primary channel and the reference channel for the one or more frequencies using the respective probability density functions.

3. The method of claim 1, further comprising maximizing the primary channel PDF and wherein estimating the another noise signal level of the reference channel, modeling the primary channel PDF of the transform coefficient of the primary channel and maximizing the primary channel PDF are effected continuously and further comprises tracking the NPLD.

4. The method of claim 3, further comprising tracking the NPLD using exponential smoothing of statistics across consecutive time frames.

5. The method of claim 4, wherein exponential smoothing of statistics across consecutive time frames comprises data-driven recursive noise power estimation.

6. The method of claim 3, further comprising determining a likelihood that speech is present in at least the primary channel of the audio signal.

7. The method of claim 6, wherein, if speech is likely to be present in at least the primary channel of the audio signal, slowing a rate at which the tracking occurs.

8. The method of claim 1, wherein the transform coefficients are fast Fourier transform (FFT) coefficients for one or more frequencies of the respective channel.

9. The method of claim 8, wherein modeling the PDF of the FFT coefficient of the primary channel of the audio signal comprises modeling a complex Gaussian PDF, with a mean of the complex Gaussian distribution being dependent upon the NPLD.

10. The method of claim 1, further comprising determining relative strengths of speech in the primary channel of the audio signal and speech in the reference channel of the audio signal.

11. The method of claim 10, wherein determining relative strengths comprises tracking the relative strengths over time.

12. The method of claim 10, wherein determining relative strengths includes data-driven recursive noise power estimation.

13. The method of claim 2, further comprising applying a least mean square (LMS) filter prior to using the NPLD and the SPLD.

14. The method of claim 3, wherein estimating the noise signal level of the reference channel, modeling the primary channel PDF and maximizing the primary channel PDF occur before at least some filtering of the audio signal.

15. The method of claim 14, wherein estimating the noise magnitude of the reference channel, modeling the primary channel PDF and maximizing the primary channel PDF occur before minimum mean squared error (MMSE) filtering of the primary channel and the reference channel.

16. The method of claim 2, wherein modeling the reference channel PDF comprises modeling a complex Gaussian distribution, with a mean of the complex Gaussian distribution being dependent on the complex SPLD coefficient.

17. The method of claim 2, wherein estimating the noise magnitude of the reference channel, modeling the respective PDFs of the transform coefficients of the primary channel and reference channel and maximizing the respective PDFs comprises scaling a noise variance of the reference channel for level difference post-processing of an audio signal after the audio signal has been subjected to a principal filtering or clarification process.

18. The method of claim 2, further comprising using the NPLD and SPLD in detecting one or more of voice activity and identifiable speaker voice activity.

19. The method of claim 1, wherein the NPLD and SPLD are used in selection between microphones to achieve the highest signal to noise ratio.

20. An audio device, comprising:

a primary microphone for receiving an audio signal and for communicating a primary channel of the audio signal;

a reference microphone for receiving the audio signal from a different perspective than the primary microphone and for communicating a reference channel of the audio signal; and at least one processing element for processing the audio signal to clarify the audio signal, the at least one processing element being configured to execute a program for effecting a method for estimating a noise power level difference (NPLD) between a primary channel and a reference channel of an audio device, the method comprising:

receiving, by the primary channel, an audio signal that has a speech signal level and a noise signal level;

receiving, by the reference channel, the audio signal with another speech signal level and another noise signal level;

estimating the noise signal level in the primary channel and the another noise signal level in the reference channel correcting for a difference between the noise signal level and the another noise signal level to minimize a noise power level difference NPLD between the primary channel and the reference channel; and modeling respective primary channel and reference channel probability density functions (PDFs) for transform coefficients for the primary channel and the reference channel of the audio signal; and using the primary channel and reference channel PDFs in correcting for the difference between the noise signal level and the another noise signal level between the primary channel and the reference channel.

21. The method of claim 20, further comprising, using a speech power level difference SPLD for correcting for the another speech level in the reference channel.

22. The method of claim 1, further comprising, using the NPLD and a speech power level difference SPLD for correcting for the another speech level in the reference channel.

* * * * *